United States Patent [19]

Wang

[11] Patent Number: 4,639,232

[45] Date of Patent: Jan. 27, 1987

[54] TOY HAVING AN ENVELOPE ENCLOSING A MOVING MECHANISM

[76] Inventor: Cheng-Chung Wang, 12th Fl., No. 440, Sec. 4, Jen-Ai Rd., Taipei, Taiwan

[21] Appl. No.: 707,476

[22] Filed: Mar. 1, 1985

[51] Int. Cl.[4] ..... A63H 3/06

[52] U.S. Cl. ..... 446/220; 446/227; 446/241

[58] Field of Search ..... 446/186, 220, 241, 236, 446/227, 431, 221, 225

[56] References Cited

U.S. PATENT DOCUMENTS 4,291,487 9/1981 Magid ..... 446/186

4,309,840 1/1982 Kulesza et al. ..... 446/241 X 4,391,062 7/1983 Magid ..... 446/220

4,559,020 12/1985 Wang ..... 446/241 X

*Primary Examiner*—Mickey Yu

*Attorney, Agent, or Firm*—Cushman, Darby & Cushman

[57] ABSTRACT

A toy includes an envelope having inside a rigid tubular member connected to the inner side of its wall and rod with a helical groove held by the tubular member in an axially movable position. The rod is passed through an opening of a transverse plate fixed to the tubular member and the helical groove is engaged with cam edges projected into the opening, thereby the rod will move upward and downward simultaneously with a rotating movement.

11 Claims, 8 Drawing Figures

TOY HAVING AN ENVELOPE ENCLOSING A MOVING MECHANISM

BACKGROUND OF THE INVENTION

1. Field of the Invention

This invention relates to a toy and particularly to a toy having an envelope enclosing a moving mechanism which operates upon movement of the envelope.

2. Description of the Prior Art

Inflatable toys with inside moving mechanisms are known in the arts. U.S. Pat. No. 4,291,487 discloses inflatable toys which include linearly movable elements inside inflatable envelopes to be operated by external cords. U.S. Pat. No. 4,391,062 discloses inflatable toys with rotational elements which can be operated by linearly moving means. The inventor also proposed an inflatable toy having an inside moving mechanism which operates upon movement of the envelope to actuate an external rotating mechanism mounted to the envelope of the toy.

SUMMARY OF THE INVENTION

An object of the invention is to provide a novel toy which includes an envelope enclosing an inside mechanism capable of producing torque upon movement of the envelope for active rotating movement.

This and other objects can be achieved in accordance with the invention through the provision of a toy which is comprised of an envelope made of a flexible material, a rigid tubular member connected to the inner side of the wall of the envelope and having a transverse fixed plate therein. The transverse plate has an opening and a cam edge projected into the opening. There is further provided a moving rod passing through the opening and mounted in the tubular member in an axially movable position. It is provided with a predetermined length of helical groove on its periphery engaged with the cam edge of the transverse plate. When the envelope is moved, the moving rod will move upward and downward simultaneously with a rotating movement resulting from the camming action of the cam edge on the helical groove. The rotating movement can be transmitted to other toy pieces which are attached to the moving rod.

The present preferred embodiments will be described in detail with reference to the accompanying drawings.

DETAILED DESCRIPTION OF THE PREFERRED EMBODIMENT

Figure 1:
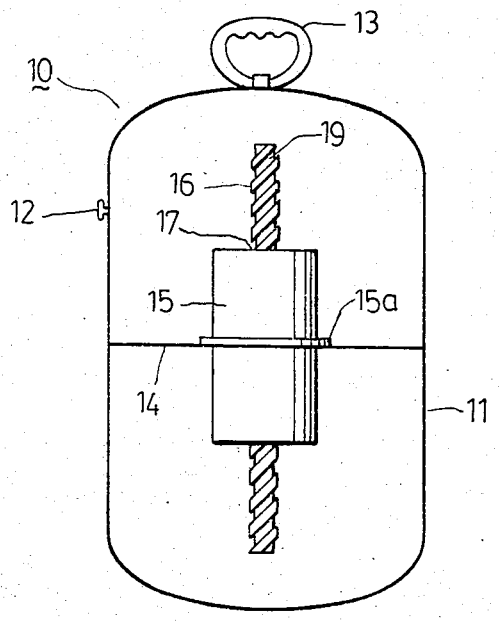
FIG. 1 is a view of the first embodiment according to the present invention.

The preferred embodiments of the invention are illustrated with reference to the drawings in which the same elements are represented by the same reference numerals. Referring to FIG. 1, there is shown an inflatable toy

Figure 2:
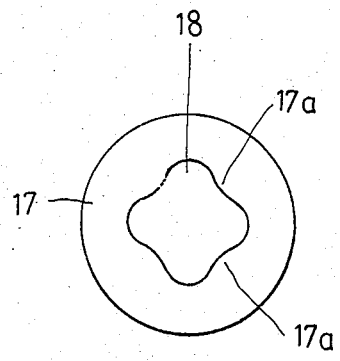
FIG. 2 is a view of the transverse fixed plate in the first embodiment.

10 which includes an envelope 11 made of a flexible material with an inflating valve 12 and a handle ring 13. Inside the envelope 11, there is provided a tubular member 15 made of a rigid or semirigid plastic material and having an annular flange 15*a* heat-welded to a PVC plastic sheet 14 which sides are heat-welded to the inner side of the wall of the envelope 11. The tubular member 15 is provided with a transverse fixed plate 17 which is provided with an opening 18 conforming to the shape of a cloverleaf as shown in FIG. 2. A moving rod 16 made of a rigid or semirigid plastic material is passed through the opening 18 and is provided with a helical groove 19 on its periphery extending from one end to the other end. The moving rod 16 is held by the tubular member 15 and its helical groove 19 is engaged with the inwardly projecting cam edges 17*a* of the plate 17. When the toy 10 is moved upward and downward by the player, the moving rod 16 moves upward and downward simultaneously with a rotating movement which results from the cam action of the edges 17*a* on the helical groove 19.

Figure 3:
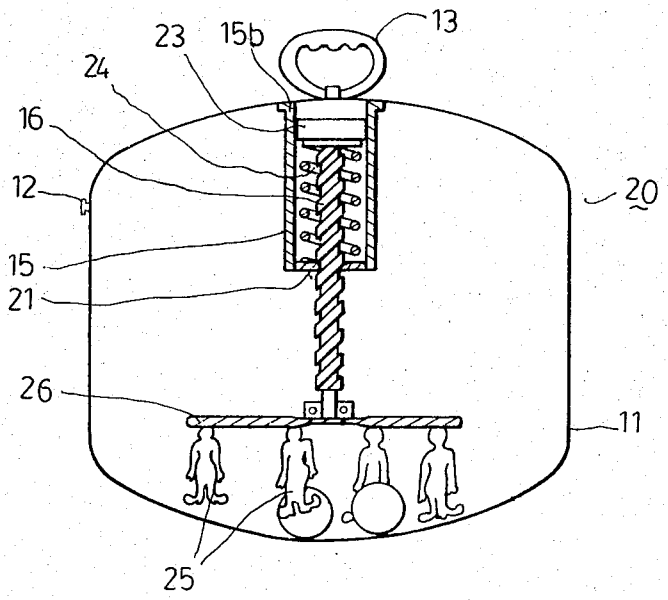
FIG. 3 is a view of the second embodiment.
Figure 4:
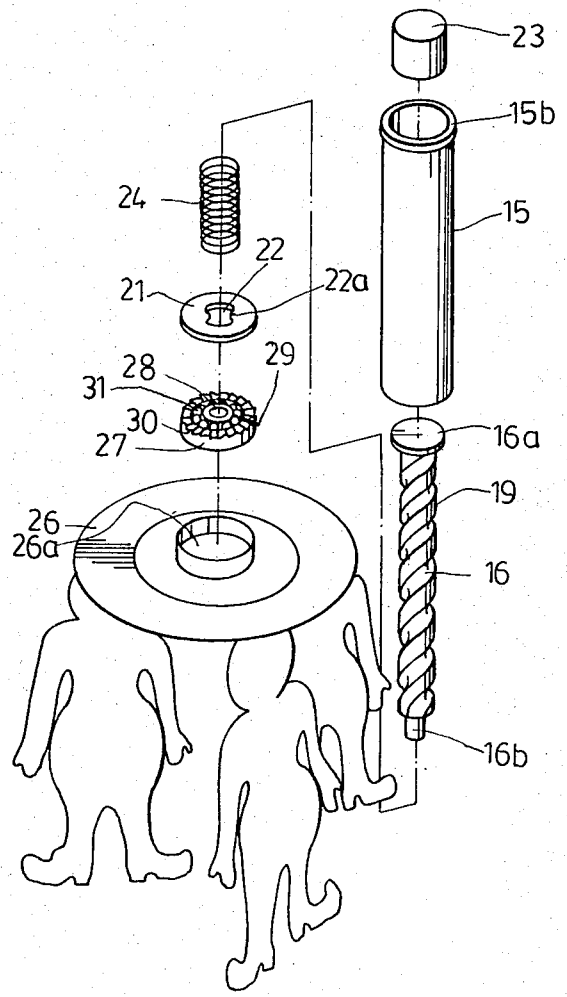
FIG. 4 is an exploded view of the inside part of the second embodiment.

Referring to FIGS. 3 and 4, there is shown a second embodiment in which a toy 20 is comprised of an envelope 11 with an inflating valve 12 and a handle ring 13. Inside the envelope 11 there is provided a tubular member 15 which has a flanged end 15*b* heat-welded to the inner side of the wall of the envelope 11. A moving rod 16 is provided in the tubular member 15 and is passed through a transverse fixed circular plate 21 having a figure-eight shaped opening 22 and cam edges 22*a* see FIG. 4.

At the top of the moving rod 16 there is a circular head 16a attached to a block 23. A helical spring 24 is sleeved onto the rod 16 between the circular head 16*a* and the circular plate 21. At the bottom end 16*b* of the rod 16 there is provided a wheel 26 on which are suspended a plurality of toy pieces 25 of various shapes. The wheel 26 includes a circular recess 26*a* in which there is placed an assembly that is constituted of an outer ring 27 and an inner ring 28 with ball members 31 provided between them. The outer ring 27 is secured to the wheel 26 by adhesive-bonding and the inner ring 28 is fixed to the bottom end 16b of the rod 16. There are further provided a plurality of annularly disposed inclined teeth 30 which are axially projected from the top side of the ring 27 and inclined in the same angular direction. A pin 29 is radially projected from the top side of the ring 28 for engaging with the inclined teeth 30.

When the moving rod 16 is moved upward and downward by operating the handle ring 13, a simultaneous rotation of the rod 16 will cause the wheel 26 to rotate. Because of the action of the pin 29 on the inclined teeth 30, the wheel 26 only moves in a single direction, whether the inner ring 28 moves clockwise or counter-clockwise.

Figure 5:
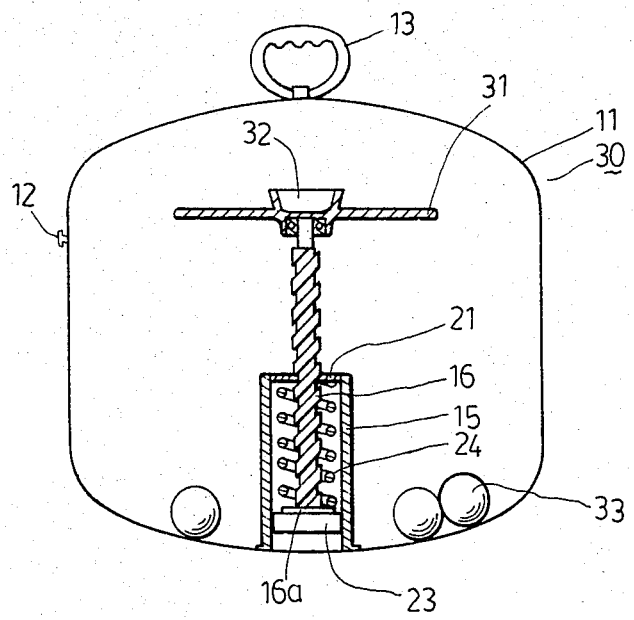
FIG. 5 is a view of the third embodiment.

Referring to FIG. 5, there is shown a third embodiment in which a toy 30 is comprised of an envelope 11, a tubular member 15 having its lower flanged end heat-welded to the inner side of the wall of the envelope 11 and a moving rod 16 mounted in the tubular member 15. A spring 24 is provided between the circular head 16*a* and the circular plate 21. The circular head 16*a* is attached to the block 23 inside tubular member 15. At the top of the rod 16 there is provided a disc 31 having a ball bunker 32. There are further provided a plurality of balls 33 in the envelope 11 which can be made to jump into the bunker 32 by the player upon operating the handle ring 13.

Figure 6:
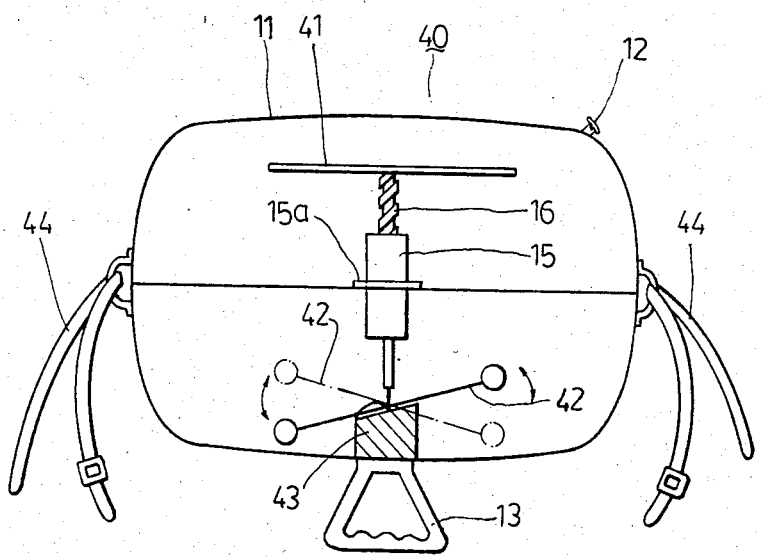
FIG. 6 is a view of the fourth embodiment.
Figure 7:
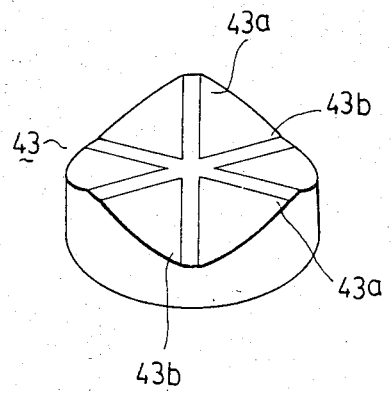
FIG. 7 is a view showing the cam member of the toy of the fourth embodiment in more detail.

The fourth embodiment is shown in FIG. 6 in which a toy 40 is comprised of an envelope 11 enclosing a tubular member 15 and a moving rod 16. The tubular member 15 has an annular flange 15*a*. The lower portion of the rod 16 is not provided with any helical groove 19. At the top of the rod 16 there is provided a disc 41 and at the bottom of the rod 16 there is provided a baton-shaped rod 42 for rotation about the axis of the rod 16. There is also provided a cam member 43 in the form of a platform secured to the inner side of the wall of the envelope 11 and having raised surfaces 43*a* and concaved surfaces 43*b*, as better shown in FIG. 7. The toy 40 can be attached to a baby's bed by attachments 44 of the envelope 11 and the handle ring 13 can be moved by using a string (not shown). When the baton-shaped rod 42 is rotated, the cam member 43 will make the rod 42 move alternately upward and downward.

Figure 8:
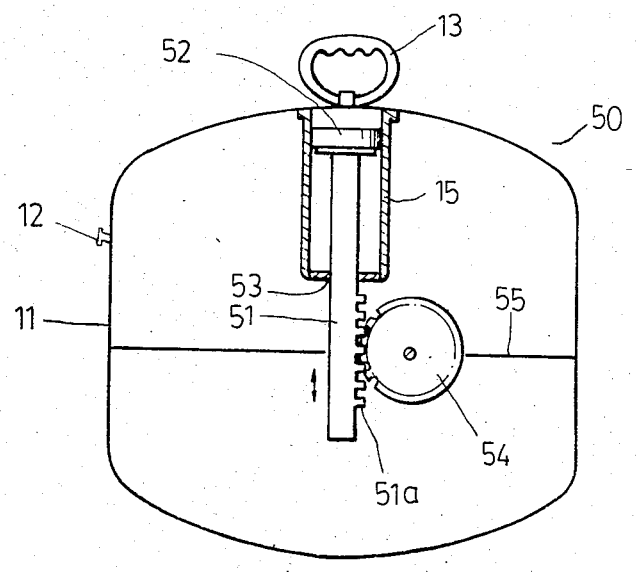
FIG. 8 is a view of the fifth embodiment.

FIG. 8 shows the fifth embodiment in which the toy 50 includes an envelope 11 with an inflating valve 12 and a handle ring 13. Inside the envelope 11 there is provided a tubular member 15 having a fixed circular plate 53 with an opening through which there is passed a rack member 51. At the top of the rack member 51 there is a circular block 52. Adjacent to the rack member 51 there is a gear member 54 which is put into mesh with teeth 51a of the rack member 51. The gear member 54 is supported by a sheet 55 which is secured to the inner side of the wall of the envelope 11. When the handle 13 is operated by a player, the upward and downward movements of the rack member 51 will cause the gear member 54 to rotate.

With the invention thus explained, it is apparent that various modifications and variations can be made without departing from the scope of the invention. It is therefore intended that the invention be limited as indicated in the appended claims.

I claim:

1. A toy comprising:

an envelope having a flexible material wall;

a sheet extending across an interior portion of the envelope and being connected to an inner side of the wall;

a rigid tubular member being centered through the sheet and having an outer periphery;

a transverse plate having a central opening and a cam edge around the opening, said transverse plate being fixed at a top end of the tubular member;

a moving rod mounted in the tubular member and passing through the central opening so as to be axially movable therethrough, said moving rod having an outer periphery, a longitudinal axis, a top end, and a bottom end; and helical grooves of predetermined length provided on the outer periphery of the moving rod so as to engage with the cam edge around the central opening in the transverse plate.

2. The toy according to claim 1, wherein:

said tubular member has an annular flange on its outer periphery, said annular flange being secured and centered onto the sheet extending across the interior of the envelope.

3. A toy comprising:

an envelope having a flexible material wall;

a rigid tubular member having a flanged end attached to an inner side of the wall at a portion of an interior portion of said envelope;

a transverse plate having a central opening and a cam edge around the opening, said transverse plate being fixed at one end of the tubular member;

a moving rod mounted in the tubular member and passing through the central opening in the transverse plate so as to be axially movable therethrough, said moving rod having an outer periphery, a top end, and a bottom end; and helical grooves of predetermined length provided on the outer periphery of the moving rod so as to engage with the cam edge around the central opening in the transverse plate.

4. The toy according to claim 3, wherein:

said central opening has a figure-eight shape with a contracted central portion; and said cam edge is formed at the contracted central portion of the figure-eight shape of the central opening.

5. The toy according to claim 3, wherein:

said central opening has a cloverleaf shape with contracted portions; and said cam edge is formed at the contracted portions of the cloverleaf shape of the central opening.

6. The toy according to claim 3, further comprising:

a circular flat head provided on the top end of the moving rod; and a helical spring sleeved around the moving rod between the circular flat head on the top end of the moving rod and the transverse plate at the bottom end of the tubular member.

7. The toy according to claim 3 further comprising:

a rotatable wheel having an underside and being provided at the bottom end of the moving rod;

means, secured to the rotatable wheel at the bottom end of the moving rod, for restricting the rotatable wheel to rotation in a single direction; and toy pieces suspended from the underside of the rotatable wheel.

8. The toy according to claim 7, wherein:

said restricting means includes an assembly comprising:

an outer ring member being secured to the rotatable wheel and having a top side;

an inner ring member being fixed to the moving rod and having a top side;

a plurality of ball members being arranged between the outer ring member and the inner ring member;

a plurality of annularly disposed inclined teeth axially projected from the top side of the outer ring member;

a pin member radially extending from the top side of the inner ring member and engaging the inclined teeth;

whereby the outer ring member is restrcited to rotation in a single direction.

9. The toy according to claim 3, further comprising:

a disc member secured at the top end of the moving rod;

a ball bunker arranged on top on the disc member; and ball members provided in the interior of the envelope.

10. The toy according to claim 1, further comprising:

a baton-shaped rod means, provided on the bottom end of the moving rod, for rotating about the longitudinal axis of said moving rod; and platform means, secured to an inner side of the wall of the envelope at a lower portion of the interior of said envelope, for camming the baton-shaped rod means to incline upwards and downwards alternatively while simultaneously rotating around the longitudinal axis of the moving rod.

11. A toy comprising:

an envelope having an interior with a wall made of a flexible material, a sheet extending across the interior of the envelope and being connected to an inner side of the wall of the envelope, a rigid tubular member having a bottom end and top flanged end attached to an inner side of the wall of the envelope at an upper portion of the interior of said envelope;

a transverse plate having a central opening and being fixed at the bottom end of the tubular member;

a moving rack member mounted in the tubular member and passing through the central opening in the transverse plate so as to be axially movable therethrough, said moving rack member having an outer periphery with teeth notched therein; and gear means, being arranged through the sheet and having an outer periphery with teeth notched therein, for engaging with the teeth notched on the outer periphery of the moving rack member.

* * * * *